US006105671A

United States Patent [19]

McKinzie et al.

[11] Patent Number: 6,105,671

[45] Date of Patent: Aug. 22, 2000

[54] METHOD AND APPARATUS FOR MINIMIZING EMULSION FORMATION IN A PUMPED OIL WELL

[75] Inventors: Howard L. McKinzie, Sugar Land; Michael R. Berry, Bellaire, both of Tex.

[73] Assignee: Texaco Inc., White Plains, N.Y.

[21] Appl. No.: 09/154,138

[22] Filed: Sep. 17, 1998

Related U.S. Application Data

[60] Provisional application No. 60/059,731, Sep. 23, 1997.

[51] Int. Cl.[7] ..... E21B 43/00

[52] U.S. Cl. ..... 166/265; 166/105.5; 210/512.1; 417/313; 418/48

[58] Field of Search ..... 210/512.1, 512.2, 210/512.3, 788; 166/265, 369, 105.5; 417/48, 410.1, 424.2, 313; 418/48

[56] References Cited

U.S. PATENT DOCUMENTS

| | | | |
|---|---|---|---|
| 2,214,064 | 9/1940 | Niles | 166/54 |
| 2,281,801 | 5/1942 | Reynolds et al. | 166/306 |
| 2,910,002 | 10/1959 | Morgan | 166/54.1 |
| 2,986,215 | 5/1961 | Barr | 166/67 |
| 3,167,125 | 1/1965 | Bryan | 166/306 |
| 3,333,638 | 8/1967 | Bishop | 166/306 |
| 3,363,692 | 1/1968 | Bishop | 166/306 |
| 3,677,665 | 7/1972 | Corkill | 417/48 |
| 3,977,469 | 8/1976 | Broussard et al. | 166/266 |
| 4,047,539 | 9/1977 | Kruka | 137/13 |
| 4,241,787 | 12/1980 | Price | 166/105 |
| 4,251,191 | 2/1981 | Gass et al. | 166/54 |
| 4,295,795 | 10/1981 | Gass et al. | 166/111 |
| 4,296,810 | 10/1981 | Price | 166/105.5 |
| 4,480,686 | 11/1984 | Coussan | 166/117.5 |
| 4,545,731 | 10/1985 | Canalizo et al. | 417/86 |
| 4,745,937 | 5/1988 | Zagustin et al. | 137/13 |
| 4,749,034 | 6/1988 | Vandevier et al. | 166/369 |
| 4,753,261 | 6/1988 | Zagustin et al. | 137/13 |
| 4,766,957 | 8/1988 | McIntyre | 166/265 |
| 4,773,834 | 9/1988 | Saruwatari | 418/48 |
| 4,793,408 | 12/1988 | Miffre | 166/53 |

(List continued on next page.)

FOREIGN PATENT DOCUMENTS

| | | |
|---|---|---|
| 2 194 572 | 3/1988 | United Kingdom . |
| 2 248 462 | 4/1992 | United Kingdom . |
| WO 97/25150 | 7/1997 | WIPO . |

OTHER PUBLICATIONS

T. Kjos et al., SPE Paper No. 030518, Society of Petroleum Engineers, 1995, pp. 689–701.

B.R. Peachey et al., Downhole Oil/Water Separation Moves Into High Gear, 37 Journal of Canadian Petroleum Technology, Jul. 1998, pp. 34–41.

James F. Lea et al., What's new in artifical lift; Part 2; advances in electrical submersible pumping equipment and instrumentation/control, plus other new artificial lift developments, World Oil, Apr., 1996, pp. 47–56.

Miller, *The American Oil & Gas Reporter,* Jan., 1997, p. 76–80.

Miller, *The American Oil & Gas Reporter,* Mar., 1997, p. 106–109.

Stuebinger et al., SPE Paper No. 38790, Society of Petroleum Engineers, 1997, pp. 1–10.

MBC Inc., Introducing a Concurrent Process of Gs Production/Water Disposal, 10 pages. (undated).

Reda, *Downhole Dewatering Systems,* 6 pages, 1997.

Chriscor, a division of IPEC Ltd., *Chriscor Downhole Water Injection Tool,* 3 pages. (undated).

*Primary Examiner*—David Bagnell
*Assistant Examiner*—Jeffrey Cader
*Attorney, Agent, or Firm*—Morris N. Reinisch; Howrey & Simon

[57] ABSTRACT

The present invention relates to a system for minimizing emulsion formation in a pumped oil well by establishing substantially core annular flow at the outlet of the system. The core annular flow regime is established at the outlet of the system through a combination of a pump outlet and a transition conduit.

22 Claims, 2 Drawing Sheets

U.S. PATENT DOCUMENTS

| | | | |
|---|---|---|---|
| 4,818,197 | 4/1989 | Mueller | 418/48 |
| 4,832,127 | 5/1989 | Thomas et al. | 166/106 |
| 4,913,630 | 4/1990 | Cotherman et al. | 417/313 |
| 5,159,977 | 11/1992 | Zabaras | 166/105 |
| 5,176,216 | 1/1993 | Slater et al. | 166/105.5 |
| 5,224,837 | 7/1993 | Lamphere et al. | 417/63 |
| 5,335,732 | 8/1994 | McIntyre | 166/313 |
| 5,425,416 | 6/1995 | Hammeke et al. | 166/108 |
| 5,431,228 | 7/1995 | Weingarten et al. | 166/357 |
| 5,497,832 | 3/1996 | Stuebinger et al. | 166/369 |
| 5,562,405 | 10/1996 | Ryall | 415/72 |
| 5,579,838 | 12/1996 | Michael | 166/186 |
| 5,667,686 | 9/1997 | Schubert | 210/512.1 |
| 5,697,448 | 12/1997 | Johnson | 166/369 |
| 5,755,554 | 5/1998 | Ryall | 415/199.5 |

METHOD AND APPARATUS FOR MINIMIZING EMULSION FORMATION IN A PUMPED OIL WELL

The present application claims priority under 35 U.S.C. §119(e) to provisional application Ser. No. 60/059,731, filed Sep. 23, 1997, the entirety of which is incorporated herein by reference.

BACKGROUND OF THE INVENTION

1. Field of the Invention

The present invention relates to an apparatus and method for enhanced production of hydrocarbons from a producing well. In particular, the present invention relates to an improved apparatus and method for enhancing the downhole separation of hydrocarbons and water produced from earth formations penetrated by a wellbore and for lifting viscous fluids from the wellbore.

2. Related Art

Conventional hydrocarbon (e.g., crude oil, natural gas, or gas condensate) production wells have been constructed in subterranean strata that yield both hydrocarbons and an undesired amount of water, such as salt water. In many of these wells, the natural pressure in the producing earth formation or reservoir is insufficient to propel or push the fluid produced from the formation to the surface of the earth. In such instances, it is necessary to use artificial lift systems to convey the produced fluids to the ground surface.

Some hydrocarbons, for example, crude oil, have a low viscosity and are relatively easy to pump from the subterranean reservoir. Others have a very high viscosity even at reservoir conditions and present numerous difficulties when attempting to bring such fluids to the ground surface.

Sucker rod pumps may be used to lift viscous hydrocarbons, but in many fields, sucker rod pumps cannot be used. For example, rod pumps are not feasible in highly deviated wells and, in many fields, limited surface rights make sucker rod pumps unfeasible.

A number of pumps such as electrical submersible pumps, electrical submersible progressive cavity pumps, and axial flow pumps have been used when sucker rod pumps, or other types of lifting systems, are not feasible. In such systems, the use of such pumps has been proposed for either the reinjection of produced water downhole, or for the artificial lifting of produced hydrocarbons to the surface. One problem in using such pumps as an artificial lift method is that they tend to impart a high shear on the produced fluids as they pass through the pump. If the well is producing both oil and water, this high shear can lead to the formation of emulsions of oil and water having very small droplet size. Such emulsions may be referred to as "tight emulsions." These emulsions may be difficult and expensive to separate in surface separation facilities.

Two examples of such systems utilizing electrical submersible pumps, for example, are shown in U.S. Pat. Nos. 4,832,127 and 4,749,034. These inventions mix water with the crude oil at relatively high shear rates to force an emulsion to form in the pump. The emulsion has an effective viscosity less than the viscosity of the crude oil because it is water continuous rather than oil continuous. These inventions make it possible to produce oils otherwise not capable of being produced by electrical submersible pumps, but an excessive amount of water injection from the ground surface is required. For example, the process of U.S. Pat. No. 4,832,127 utilizes from 300 to 1,200 barrels of water per day to produce about 225 barrels of oil. This excessive amount of water results in larger pumps, motors, and surface separation equipment. Further, because an emulsion is created, surface separation equipment must be capable of breaking the emulsion.

If such emulsions have an oil-continuous phase (i.e., a "water-in-oil emulsion" having water droplets dispersed in an oil medium), they may also possess a viscosity that can be much higher than that of the base crude oil. The increased viscosity can then result in the use of additional energy to pump the resulting emulsion through production tubing to the surface.

To overcome this problem, several devices and schemes have been proposed to separate the oil and water downhole thereby minimizing or eliminating the formation of the oil/water emulsion. Some of these systems rely on the downhole natural gravity separation of the oil and water. Other systems, however, rely on known separation devices, such as hydrocyclones, which divide the oil and water into separate streams to be handled in separate, individual tubing strings. The separated oil can then be pumped to the surface and the separated water can be disposed of downhole or be pumped to the ground surface via the separate tubing.

Other proposed systems, such as the system shown in U.S. Pat. No. 5,159,977, utilize oil/water core flow at the pump inlet in order to reduce electrical motor temperature rise and the frictional pressure drop in the production tubing while increasing pump efficiency. However, this invention requires water to be injected from the ground surface, albeit less than prior known systems, which may result in larger pumps, motors, and surface separation equipment.

Methods for establishing core annular flow in pipelines have been disclosed in, for example, U.S. Pat. Nos. 3,977,469, 4,047,539, 4,745,937, and 4,753,261. These processes establish a core flow of a viscous fluid within a core of a less viscous fluid in order to reduce the pressure drop in the pipeline. These inventions, however, do not disclose or suggest an apparatus or method to consistently create core annular flow at the outlet of an electrical submersible pump, electrical submersible progressive cavity pump, or an axial flow pump.

Generally, these pumps may be used in relatively high rate wells where natural (gravity) separation in the wellbore would not occur. The conventional method of achieving downhole separation in wells utilizing such pumps would require the use of a hydrocyclone at the inlet of the pump and two separate pumps at the outputs of the hydrocyclone to handle the separated water and oil streams.

Thus, there is a need in the art for an apparatus and method that substantially obviates one or more of the limitations and disadvantages of conventional pumping systems. Particularly, it would be highly desirable to provide such a pump which does not impart undue shear to the produced oil and water. This would reduce or substantially eliminate the formation of an oil/water emulsion. Furthermore, it would be desirable to provide a pump that could enhance the separation of produced oil and water downhole without requiring the injection of excess water from the ground surface.

SUMMARY OF THE INVENTION

In one aspect of the present invention, a pump is provided for conducting produced fluids from a producing well to a ground surface. The invention includes a pump section, and a pump outlet disposed at one end of the pump section and in fluid flow communication with the pump section. A transition conduit having an inlet and an outlet is coupled to the pump outlet. The pump outlet is configured to accelerate produced fluids in a tangential direction toward the transition conduit so that produced fluids exiting the transition conduit are in substantially core annular flow. The invention also includes an outlet conduit in fluid flow communication with the transition conduit for conducting produced fluids to the ground surface.

In another aspect of the present invention, a method for conducting produced fluids, including hydrocarbons and water, from a producing well to a ground surface is provided.

The method includes pumping produced fluids through a pump section into a pump outlet disposed at one end of the pump section. The method further includes accelerating the produced fluids entering the pump outlet in a substantially tangential direction and towards an inlet of a transition conduit coupled to the pump outlet. In addition, the method includes forcing the accelerated produced fluids through the transition conduit thereby further accelerating the produced fluids in the tangential direction and increasing the centripetal and centrifugal forces acting on the produced fluids such that the produced hydrocarbons and produced water separate into substantially core annular flow. The method further includes conducting the separated hydrocarbons and water up an outlet conduit to the ground surface.

FEATURES AND ADVANTAGES

The present invention provides an improved pump to enhance oil and water separation within the pump, preferably, at its outlet. The improved pump, at least partially, breaks any oil and water emulsion created by its pump section and causes separated water to be conducted radially outwardly, preferably in the pump outlet to the wall of the tubing outlet. The oil and any remaining emulsion may be located geometrically near the axis or center portion of the tubing. This radial distribution of the fluid results in what is generally known as "core annular flow," wherein the heavier water tends toward the outside of the wall of the tubing outlet while the oil tends to stay toward the central axis of the tubing outlet as the fluids flow through the tubing.

The promotion of core annular flow results in several advantages. Among these are: 1) reducing the effective viscosity of the emulsion; 2) reducing drag along the tubing wall; 3) reducing the "tightness" of the emulsion, thereby increasing the effectiveness of the separation facilities at the ground surface; 4) reducing the amount of chemical emulsion breaker and/or facilities required for separation; 5) increasing the throughput of the separation facilities without adding additional equipment; and 6) simplifying the equipment required for downhole separation. Core annular flow may, however, be relatively short lived if the viscosity of the inner (radial) fluid is much less than 1000 centipoise. Even if core annular flow cannot be sustained along the entire length of the outlet tubing to the ground surface, there are large advantages in separating the oil and water into two phases, rather than producing the mixture as a tight emulsion which is difficult and expensive to separate at the ground surface.

In the present invention, the preferred embodiments of the improved pump accelerate the oil/water emulsion in a tangential direction as it is exiting from the pump outlet. Separation occurs because of an increase in centrifugal force (which is generally discussed in terms of the gravitational constant or "g") which pulls the heavier fluid component (e.g., water) to the outside of the boundary of the device (e.g., tubing) and a corresponding increase in centripetal force which forces the lighter fluid component (e.g., oil) to the center or axis of the device. A major difference between using the pump system of the present invention from the use of conventional hydrocyclone separators is that in the present invention a single output tubing string transports the separated fluids in substantially core annular flow to the ground surface. This reduces the amount of, and complexity of, the equipment used downhole to separate the oil and water.

Moreover, the present invention overcomes the problems with conventional systems in that it substantially separates the emulsion of oil and water at the outlet of the pump. Furthermore, the present invention provides a pump that enhances the separation of produced oil and water downhole without requiring the injection of excess water from the ground surface.

The invention may best be understood by the following detailed description taken in conjunction with the accompanying drawings. These descriptions and drawings are intended as illustrative of the invention and should not be construed as limitations thereon.

BRIEF DESCRIPTION OF THE DRAWINGS

The accompanying drawings, which are incorporated in and constitute a part of this specification, illustrate embodiments of the invention and, together with the description, serve to explain the features, advantages, and principles of the invention.

DETAILED DESCRIPTION OF THE PREFERRED EMBODIMENTS

Reference will now be made in detail to the present preferred embodiments of the invention, examples of which are illustrated in the accompanying drawings. The exemplary embodiments of this invention are shown in some detail, although it will be apparent to those skilled in the relevant art that some features which are not relevant to the invention may not be shown for the sake of clarity.

Figures 1A, 1B:
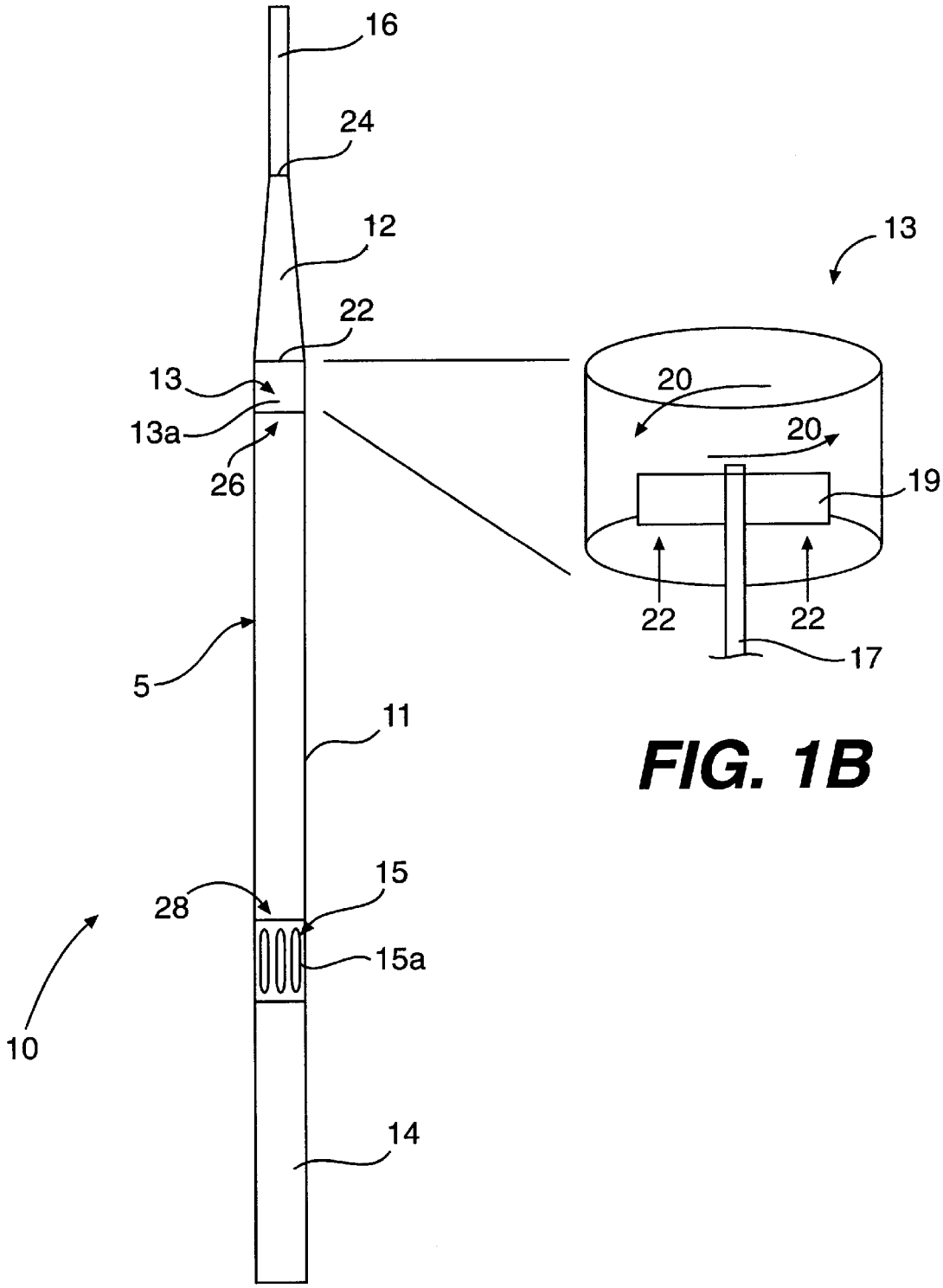
FIG. 1*a* is a schematic sectional view of an embodiment of the present invention showing a pump with a pump outlet.
FIG. 1*b* is a schematic detailed view of an exemplary pump outlet according to the present invention.

Referring to FIG. 1*a,* there is illustrated, in a schematic sectional view, an exemplary embodiment of the present invention and is represented generally by the reference numeral 10. A pump, shown generally by the reference numeral 5, preferably includes a pump section 11. Pump 5 is preferably an electrical submersible pump, and more preferably, an electrical submersible centrifugal pump. In such an embodiment, pump section 11 preferably includes a series, or plurality, of impeller or centrifugal pump stages, each pump stage including one or more impellers. In an alternate embodiment of the present invention, pump 5 is an electrical submersible progressive cavity pump. In such an embodiment, pump section 11 includes one or more progressive cavity pump stages, each of which includes a rotor and a stator. An exemplary electrical submersible progressive cavity pump suitable for use with the present invention is shown in U.S. Pat. No. 3,677,665, the entirety of which is incorporated herein by reference. In a further alternate embodiment of the present invention, pump 5 is an axial flow pump. In such an embodiment, pump section 11 preferably includes one or more axial flow stages, each of which preferably includes an impeller and a stator, or a rotor and a stator. Exemplary axial flow pumps suitable for use with the present invention are shown in U.S. Pat. Nos. 5,562,405 and 5,755,554, the entirety of both of which are incorporated herein by reference.

Pump section 11 is preferably driven by an electric motor which is encased within a motor section 14 at the lower end of pump 5. Preferably, motor or motor section 14 is disposed below pump section 11. The placement of motor 14 will, of course, depend on various factors, such as the size of motor 14 or the dimensions of the producing well.

A pump outlet 13 is shown disposed at an upper end 26 of pump section 11 and preferably in fluid flow communication with pump section 11. It should be understood by one skilled in the art that the present invention embraces the use of more than one pump outlets 13. For example, it may be necessary to use two or more pump outlets 13 in order to provide separation of the oil and water which results in substantially core annular flow as will be described in more detail below.

A transition conduit 12 is shown connected to pump outlet 13 and in fluid flow communication therewith. Transition conduit 12 may preferably be connected or attached at its inlet 22 to a housing 13*a* of pump outlet 13 by any suitable method, such as, but not limited to, welding or via threaded connections. Additionally, transition conduit 12 may preferably be connected at its outlet 24 to a fluid outlet conduit 16 by any suitable method.

As shown in FIG. 1*a,* transition conduit 12 preferably tapers from a larger cross-sectional area at inlet 22 to a smaller cross-sectional area at outlet 24. This reduction in surface area causes produced fluids which flow into inlet 22 of transition conduit 12 from pump outlet 13 to be accelerated in a tangential direction which will be described in more detail below. Preferably, transition conduit 12 is conical in shape and therefore the surface areas at inlet 22 and outlet 24 are circular. It should, however, be apparent to one of ordinary skill in the art that transition conduit 12 may be other suitable shapes as long as the further tangential acceleration of the produced fluids flowing through transition conduit 12 can be maintained.

Fluid outlet conduit 16, as noted above, is preferably connected to transition conduit 12 by any suitable method. Fluid outlet conduit 16 may be a production tubing string which extends from the ground surface downwardly through the well. Fluid outlet conduit 16 is in fluid flow communication with transition conduit 12 thereby providing a flow path to the ground surface for the separated produced fluids which will be described in more detail below. Pump 5 may also be suspended in the production well from fluid outlet conduit 16.

An inlet 15 is preferably disposed at a lower end 28 of pump section 11. As shown in the exemplary embodiment in FIG. 1*a,* inlet 15 may be sets of perforations 15*a*. Alternatively, inlet 15 may be a port or multiple ports or other suitable mechanisms for conducting fluid flow. Preferably, however, inlet 15 will be sets of perforations 15*a*. Inlet 15 is configured to permit the produced fluids to enter pump section 11 which will be described in more detail below.

Reference will now be made to the operation of the first embodiment as shown in FIGS. 1*a* and 1*b*. In FIG. 1*b,* pump outlet 13 is shown in more detail, but still schematically. A drive shaft 17 is shown (in partial view) extending from motor 14 into pump outlet 13 where it is connectable to preferably a pair of rotating vanes 19. It should be understood by one of ordinary skill in the art that any number of rotating vanes 19 may be used, for example, one, two, or more than two, depending on the amount of fluid acceleration desired and the physical limitations of pump 5. As shown in FIG. 1*b,* rotating vanes 19 are preferably rectangular in shape but it should be apparent that other shapes are embraced by the present invention.

As produced fluids (i.e., hydrocarbons and water) are withdrawn from a subterranean reservoir, the produced fluids are drawn into pump section 11 of pump 5 through perforations 15*a*. The produced fluids are transported through pump section 11 in a well-known manner. The produced fluids exiting pump section 11 enter pump outlet 13 in an axial direction (as shown by arrows 22 in FIG. 1*b*). Once inside pump outlet 13, the rotation of vanes 19 causes the produced fluids entering axially from below to be tangentially accelerated in the direction of arrows 20 and simultaneously forced to inlet 22 of transition conduit 12. As the produced fluids are forced through transition conduit 12 toward outlet 24, or narrower end of transition conduit 12, the reduction in diameter of conical transition conduit 12 causes further tangential acceleration of the fluids.

The further tangential acceleration of the produced fluids within transition conduit 12 increases the centripetal and centrifugal forces, or "g" forces, acting on the produced fluids. This tends to cause separation of the produced oil and water as they are forced toward outlet 24. The heavier water tends toward the outside or wall of outlet conduit 16 while the oil and any remaining oil/water emulsion stay toward the central axis of outlet conduit 16. This separates the produced fluids into substantially a core annular flow regime of the oil and water in outlet conduit 16. The separated produced fluids continue up outlet conduit 16 to the ground surface where they may be collected in a suitable manner.

Figures 2A, 2B:
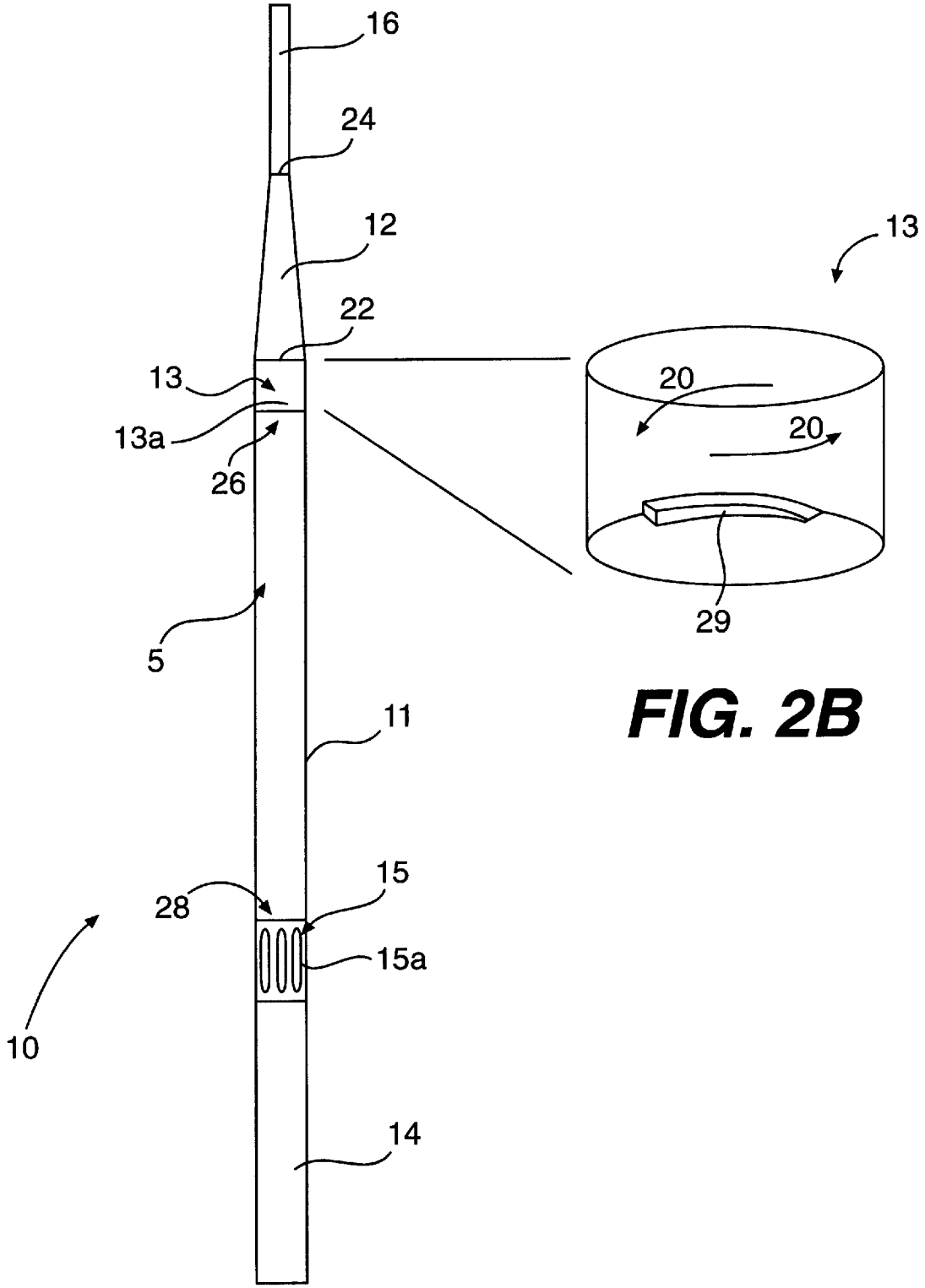
FIG. 2*a* is a schematic sectional view of a second embodiment of the present invention showing a pump with a pump outlet.
FIG. 2*b* is a schematic detailed view of a second exemplary pump outlet according to the present invention.

Reference will now be made to FIG. 2*a*, where a second embodiment of the present invention is shown schematically. Like reference numerals will be used where appropriate to describe similar elements to those of the embodiment shown in FIGS. 1*a* and 1*b*.

Referring to FIG. 2*a*, there is illustrated, in a schematic sectional view, a second exemplary embodiment of the present invention and is represented generally by the reference numeral 10. A pump, shown generally by the reference numeral 5, preferably includes a pump section 11. Pump 5 is preferably an electrical submersible pump and pump section 11 preferably includes a series, or plurality, of impeller or centrifugal pump stages, the configuration of which would be readily apparent to one of skill in the art. In a manner similar to that discussed with respect to FIGS. 1*a* and 1*b,* pump 5 can also be an electrical submersible progressive cavity pump or a weir pump.

Pump section 11 is preferably driven by an electric motor that is encased within motor section 14 at the lower end of pump 5. Preferably, motor or motor section 14 is disposed below pump section 11. In addition, inlet 15 is preferably disposed at a lower end of pump section 11.

An alternate embodiment of pump outlet 13 is shown disposed at upper end 26 of pump section 11 and preferably in fluid flow communication with pump section 11. Transition conduit 12 is also shown connected to a housing 13*a* of pump outlet 13 and in fluid flow communication therewith.

As noted above with respect to FIG. 1*a,* and as shown in FIG. 2*a*, transition conduit 12 preferably tapers from a larger cross-sectional area at inlet 22 to a smaller cross-sectional area at outlet 24. This reduction in surface area causes produced fluids which flow into the inlet 22 of transition conduit 12 from pump outlet 13 to be accelerated in a tangential direction which will be described in more detail below.

Fluid outlet conduit 16 is provided and is preferably connected to transition conduit 12 by any suitable method. Fluid outlet conduit 16 may be a production tubing string which extends from the ground surface downwardly through the well. Fluid outlet conduit 16 is in fluid flow communication with transition conduit 12 thereby providing a flow path for the separated produced fluids to the ground surface which will be described in more detail below. The pump 5 may also be suspended in the production well from fluid outlet conduit 16.

Reference will now be made to the operation of the second embodiment as shown in FIGS. 2*a* and 2*b*. In FIG. 2*b*, pump outlet 13 is shown in more detail, but still schematically. An output nozzle 29, in fluid flow communication with pump section 11, is disposed in pump outlet 13 as shown in FIG. 2*b*. Nozzle 29 is configured to accelerate t he produced fluids entering pump outlet 13 from pump section 11 in a substantially tangential direction which will be described below. It should be understood by one of ordinary skill in the art that a plurality of nozzles may be employed in the present invention depending, of course, upon the p articular characteristics of the producing well.

As produced fluids (i.e., hydrocarbons and water) are withdrawn from a subterranean reservoir, the produced fluids are drawn into pump section 11 through perforations 15*a*. The produced fluids are transported through the plurality of pump stages disposed in pump section 11 in a suitable manner. As the produced fluids exit pump section 11 and enter pump outlet 13, nozzle 29 disposed therein accelerates the produced fluids in a tangential direction, as shown by arrows 20, within pump outlet 13. Simultaneously, the produced fluids are forced towards inlet 22 of transition conduit 12. As the produced fluids are forced through transition conduit 12 toward outlet 24, or narrower end of transition conduit 12, the reduction in diameter of conical transition conduit 12 causes further tangential acceleration of the fluids resulting in separation of the produced fluids and substantially core annular flow through outlet conduit 16 to the ground surface as described above.

CONCLUSION

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

We claim:

1. A pump for conducting produced fluids from a producing well to a ground surface comprising:

a pump section comprising an upper end and a lower end;

a pump outlet disposed at one end of said pump section and in fluid flow communication with said pump section;

a transition conduit having an inlet and an outlet coupled to said pump outlet, wherein said pump outlet is configured to accelerate produced fluids in a tangential direction toward said transition conduit and wherein produced fluids exiting said transition conduit are in substantially core annular flow; and an outlet conduit in fluid flow communication with said transition conduit for conducting produced fluids to the ground surface.

2. The pump according to claim 1, wherein said pump outlet comprises a rotating vane, said rotating vane capable of causing produced fluids entering said pump outlet in an axial direction to be accelerated in a tangential direction toward the inlet of said transition conduit.

3. The pump according to claim 2, wherein said transition conduit tapers from a larger cross-sectional area at the inlet of said transition conduit to a smaller cross-sectional area at the outlet of said transition conduit, thereby causing the produced fluids to be further accelerated in the tangential direction.

4. The pump according to claim 1, wherein said transition conduit tapers from a larger cross-sectional area at the inlet of said transition conduit to a smaller cross-sectional area at the outlet of said transition conduit, thereby causing the produced fluids to be further accelerated in the tangential direction.

5. The pump according to claim 4, wherein said transition conduit is conical.

6. The pump according to claim 1, wherein said outlet conduit is a tubing string extending from the ground surface and coupled to the outlet of said transition conduit.

7. The pump according to claim 1, wherein said pump outlet comprises a nozzle, said nozzle configured to cause produced fluids entering said pump outlet to be accelerated in a tangential direction toward the inlet of said transition conduit.

8. The pump according to claim 7, wherein said transition conduit tapers from a larger cross-sectional area at the inlet of said transition conduit to a smaller cross-sectional area at the outlet of said transition conduit, thereby causing the produced fluids to be further accelerated in the tangential direction.

9. The pump according to claim 8, wherein said transition conduit is conical.

10. The pump according to claim 1, further comprising:

an inlet disposed at an end of said pump section remote from said one end, said inlet configured to conduct produced fluids into said pump section.

11. The pump according to claim 1, further comprising:

a motor for driving said pump section.

12. The pump according to claim 11, wherein said motor is disposed below said pump section.

13. The pump according to claim 1, wherein said pump section comprises an impeller.

14. The pump according to claim 1, wherein said pump section comprises a rotor and a stator.

15. The pump according to claim 14, wherein said rotor and said stator are disposed in an axial flow stage.

16. The pump according to claim 14, wherein said rotor and said stator are disposed in a progressive cavity pump stage.

17. The pump according to claim 1, wherein said pump section comprises an impeller and a stator.

18. The pump according to claim 1, wherein said pump section comprises a plurality of pump stages.

19. A method for conducting produced fluids, including hydrocarbons and water, from a producing well to a ground surface comprising the steps of:

pumping produced fluids through a pump section into a pump outlet disposed at an end of the pump section;

accelerating the produced fluids entering the pump outlet in a substantially tangential direction and towards an inlet of a transition conduit coupled to the pump outlet;

forcing the accelerated produced fluids through the transition conduit thereby further accelerating the produced fluids in the tangential direction and increasing the centripetal and centrifugal forces acting on the produced fluids such that the produced hydrocarbons and produced water separate into substantially core annular flow; and conducting the separated hydrocarbons and water up an outlet conduit to the ground surface.

20. The method according to claim 19, wherein the accelerating step is performed using a rotating vane disposed in the pump outlet.

21. The method according to claim 19, wherein the accelerating step is performed using a nozzle disposed in the pump outlet.

22. The method according to claim 19, further comprising the step of:

collecting the substantially separated hydrocarbons and water at the ground surface.

* * * * *